US008033934B1

(12) United States Patent
Clancy

(10) Patent No.: US 8,033,934 B1
(45) Date of Patent: Oct. 11, 2011

(54) BASEBALL HITTING APPARATUS

(76) Inventor: Tommy Clancy, Kissimee, FL (US)

( * ) Notice: Subject to any disclaimer, the term of this patent is extended or adjusted under 35 U.S.C. 154(b) by 0 days.

(21) Appl. No.: 12/753,246

(22) Filed: Apr. 2, 2010

(51) Int. Cl.
*A63B 69/00* (2006.01)
*A63B 71/00* (2006.01)

(52) U.S. Cl. ..... 473/430; 473/422; 473/451

(58) Field of Classification Search ..... 473/422, 473/417, 431, 451, 423–430
See application file for complete search history.

(56) References Cited

U.S. PATENT DOCUMENTS

| | | | | |
|---|---|---|---|---|
| 2,633,320 | A * | 3/1953 | Salmi | 248/123.2 |
| 3,271,030 | A * | 9/1966 | Mueller | 473/423 |
| 3,367,655 | A * | 2/1968 | Navran | 473/430 |
| 3,550,938 | A * | 12/1970 | Cunningham, Jr. | 473/429 |
| 4,664,374 | A * | 5/1987 | Groves | 473/417 |
| 4,867,488 | A | 9/1989 | Jones | |
| 5,135,219 | A | 8/1992 | McKeon | |
| 5,156,402 | A | 10/1992 | Hart | |
| 5,228,683 | A * | 7/1993 | Beimel | 473/427 |
| 5,540,430 | A * | 7/1996 | Nichols et al. | 473/418 |
| 5,605,326 | A * | 2/1997 | Spear, Jr. | 473/422 |
| 6,334,821 | B1 * | 1/2002 | Kita | 473/430 |
| 6,475,108 | B1 * | 11/2002 | Sarenana et al. | 473/420 |
| 6,688,994 | B2 | 2/2004 | Matulek | |
| 6,790,150 | B1 | 9/2004 | Moss | |
| 7,674,194 | B2 * | 3/2010 | Lortscher | 473/417 |
| 2002/0183140 | A1 | 12/2002 | Lamb | |
| 2006/0035730 | A1 * | 2/2006 | Nguyen | 473/417 |
| 2006/0135292 | A1 | 6/2006 | Griffin | |
| 2007/0049426 | A1 * | 3/2007 | Huang | 473/417 |
| 2008/0064534 | A1 | 3/2008 | Lortscher | |
| 2008/0248900 | A1 | 10/2008 | Hernandez | |
| 2009/0082140 | A1 * | 3/2009 | Liao | 473/417 |
| 2009/0239686 | A1 | 9/2009 | Moos | |
| 2010/0304900 | A1 * | 12/2010 | Gu | 473/419 |

FOREIGN PATENT DOCUMENTS

DE 3232323 A1 * 3/1984

* cited by examiner

*Primary Examiner* — Mitra Aryanpour
(74) *Attorney, Agent, or Firm* — Daniel Law Offices, P.A.; Jason T. Daniel, Esq.

(57) ABSTRACT

A collapsible and portable baseball hitting apparatus including vertical members connected to an adjustable horizontal member having a tether and baseball suspended therefrom. In another configuration, the horizontal member can fold toward the vertical members, exposing a ball tee from which a user can place a ball for hitting.

8 Claims, 4 Drawing Sheets

BASEBALL HITTING APPARATUS

BACKGROUND

1. Field of the Invention

The present invention relates generally to athletic swing trainers, and more particularly to an apparatus for hitting a baseball from a plurality of stationary positions.

2. Description of the Related Art

One of the most important aspects of a good sports swing is the ability to consistently make solid contact between the stick and the ball. Novice players typically learn the basics of accurately swinging a baseball bat by hitting a stationary ball placed atop a tee. To this end, the sport of tee ball was created to allow young players to learn how to play baseball without having to hit a moving ball. As such, conventional tee ball stands having a single vertical shaft with a ball placed on top are well known in the art.

However, owing to the design of a conventional tee ball stand, users can do little more than swing a bat level with respect to the ball. In cases where the bat is swung at an angle, it will often make contact with the stand instead of the ball. As such, when a users batting skills increase, the usefulness of the tee ball stand diminishes greatly.

As a players batting skill increases, it becomes necessary to adjust the angle and speed of the swing in order to direct the ball to a specific location. Moreover, these skills are necessary to be able to eventually hit a moving baseball that is thrown from a pitcher. As such, several devices dedicated to swing training are known. For example, U.S. Patent Publication No. 2006/0135292 describes a swing trainer that includes an overhead horizontal member attached to a vertical shaft which contains a ball permanently affixed to the end. U.S. Pat. No. 6,790,150 describes a large device having an overhead horizontally extending pipe from which a removable ball is suspended via a rope. Other examples include U.S. Pat. No. 6,688,994 and U.S. Patent Publication No. 2008/0248900.

However, in each case these trainers are large, bulky devices that can not be easily set up or transported by young players. Moreover, these devices do not provide a means for transitioning from a tee ball stand for beginners and a more advanced swing trainer for use as the players' skill level advances.

Accordingly, it would be beneficial to provide a single apparatus capable of transitioning from a tee ball stand for beginners, to a swing trainer for use as the players' skill level increases. Additionally, it would be beneficial to provide an apparatus that is lightweight, collapsible and portable, such that the device can be carried by a player inside a typical baseball bag.

SUMMARY OF THE INVENTION

The present invention is directed to an apparatus for hitting a baseball from a plurality of stationary positions. One embodiment of the baseball hitting apparatus can include vertical shafts connected to an adjustable horizontal shaft having a tether and baseball suspended therefrom.

Another embodiment of the present invention can include the ability to fold the horizontal shaft toward the vertical shafts, and to position the second vertical shaft within the first vertical shaft in order to provide a collapsible apparatus having an overall dimension approximating the length and width of a baseball bat.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention. As used herein a baseball can include any one of a whiffleball, a softball or other similar type ball.

Figure 1:
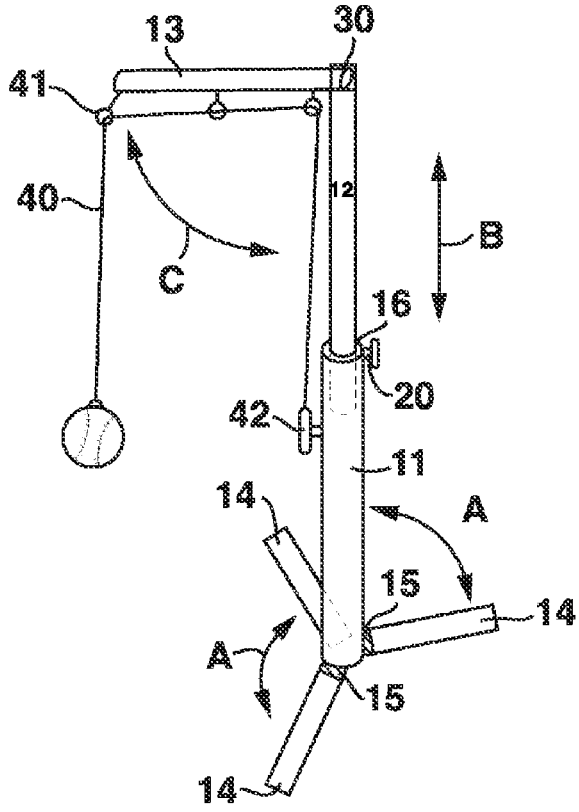
FIG. 1 is a frontal elevation of a baseball hitting apparatus that is useful for understanding the embodiments disclosed herein.

FIG. 1 illustrates one embodiment of a baseball hitting apparatus that is useful for understanding the embodiments disclosed herein. As shown, apparatus 10 can include lower vertical shaft 11, upper vertical shaft 12, horizontal shaft 13 and any number of folding legs 14.

Lower shaft 11 can preferably be constructed from an elongated tubular material having a hollow interior and an opening 16 located at the top of the shaft into which a portion of the upper vertical shaft 12 can be inserted. A plurality of folding legs 14 can be positioned along the bottom of the lower shaft 11 in order to allow the apparatus 10 to stand in an upright position. In one preferred embodiment, the apparatus can include three folding legs, each made from a hardened flat elongated material and secured to the bottom of the lower shaft 11 via a hinge 15 or other known securing means capable of allowing each leg to fold into and away from the lower shaft 10 at an angle of up to 90 degrees (see arrow A).

Upper shaft 12 can be interposed between the bottom shaft 11 and the horizontal shaft 13. Upper shaft 12 can preferably be constructed from an elongated tubular material having an outer dimension/diameter that is less than the inner (hollow) dimension/diameter of the lower shaft 11. To this end, upper shaft 12 can be housed within lower shaft 11 such that a portion of the upper shaft can extend telescopically from opening 16, in order to adjust the height of the horizontal shaft 13 (see arrow B). Moreover, upper shaft 12 can also rotate with respect to the lower shaft 11 in order to change the position of the horizontal shaft.

Figure 2:
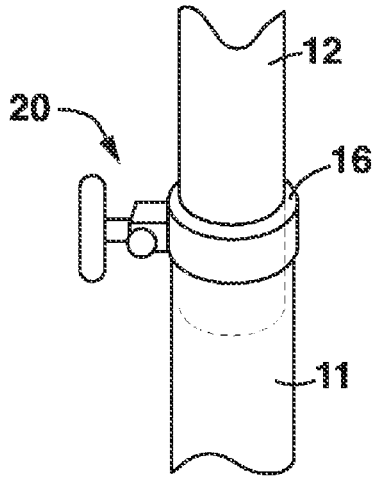
FIG. 2 is a side elevational view of an illustrative attachment collar according to one embodiment of the present invention.

As shown in FIG. 2, upper shaft 12 can be positioned within lower shaft 11 via attachment collar 20. As shown, attachment collar 20 can act to reduce the diameter of the opening 16 so as to securely position the upper shaft 12 within the lower shaft 11, thus preventing movement and providing stability of the apparatus. Attachment collars of this type are well known in the art and can include, for example, a locking pin, and/or a mechanical belt or collar.

Figure 3:
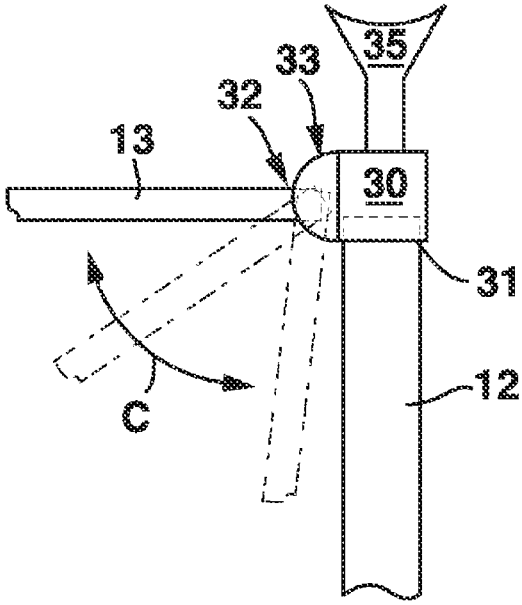
FIG. 3 is a side section detail of a rotatable hinge section according to one embodiment of the present invention.

As shown in FIG. 3, horizontal shaft 13 can be attached to the upper shaft 12 via hinge 30. As shown, hinge 30 can include connection panels 31 and 32 for securing the hinge to the vertical and horizontal shafts, respectively. Moreover, hinge 30 can further include a rotatable area 33 in order to allow the horizontal shaft to rotate with respect to the vertical shafts (see arrow C). Of course, the description of the hinge 30 is for illustrative purposes only, as any number of other known hinge devices capable of performing similar features may also be utilized.

In an alternative embodiment, hinge 30 can further include a ball tee 35. As shown, tee 35 can be positioned on top of the hinge 30 and can include a concave upper portion into which a baseball can be placed. To this end, it is preferable that the ball tee 35 be constructed from impact absorbing hard rubber or rubber coated plastic, however other materials and known tee shapes for holding a ball are also contemplated.

Figure 4:
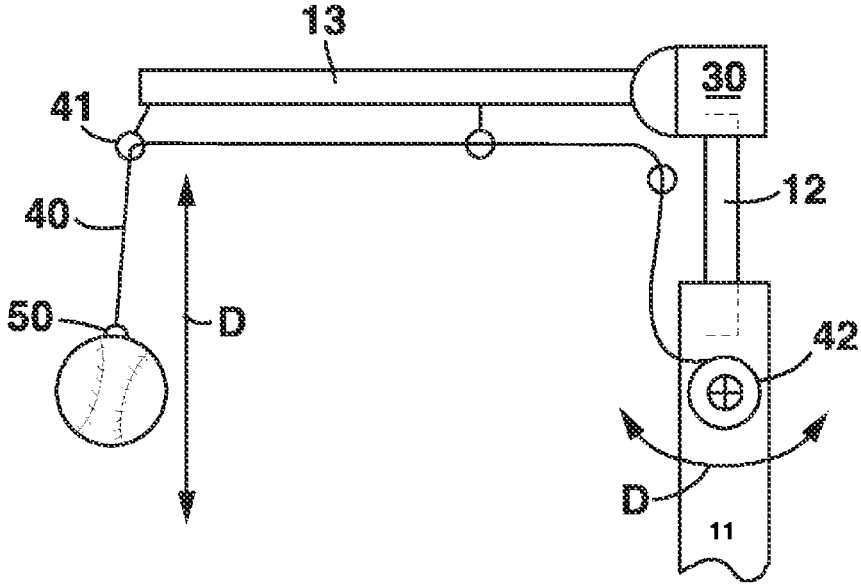
FIG. 4 is a side section detail of a tether as used in one embodiment of the present invention.

As shown in FIG. 4, the apparatus can further include a tether 40 having a baseball attachment unit 50 on one end, and a spindle 42 attached to the opposite end. As shown, the tether can be routed through a plurality of guides 41 located along the horizontal and upper shafts while the spindle 42 can be located on the lower shaft. As such, depending on the direction the spindle is rotated, the tether will be either raised or lowered, as shown by arrow D. As used herein, a tether can be virtually any form of rope or string having good tensile strength, and a spindle can include a stationary element (i.e. cleat) around which the tether 40 can be wrapped, or can include a circular appendage having a connection point in the middle, and capable of being rotated by a user (see also arrow D) in order to receive and distribute the tether. Spindle elements of these types are extremely well known in the art, thus no further description is necessary.

Figure 8:
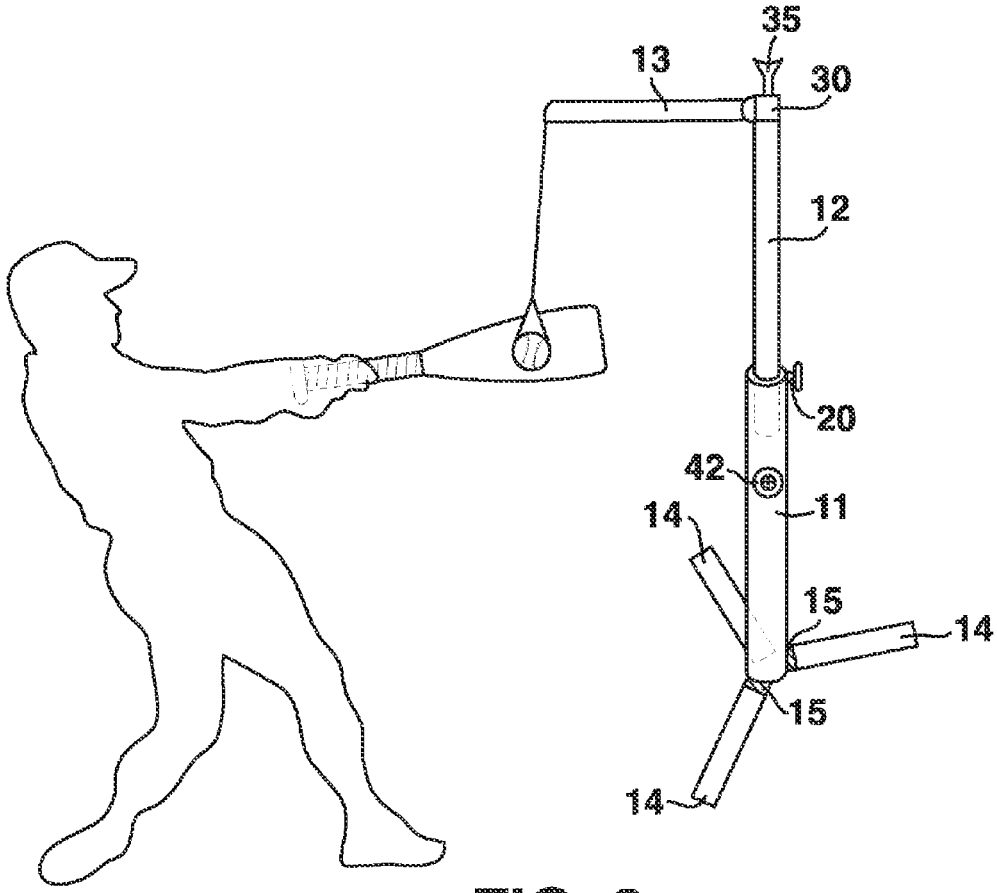
FIG. 8 is a side view of a player using the apparatus in a swing training configuration.

Although described above with respect to external locations, one of skill in the art will recognize that one or more of the guides 41, and at least a portion of the tether 40 and spindle 42 can be located within the shafts of the apparatus without departing from the scope or spirit of the invention (see FIG. 8). Such a configuration may be useful in order to provide a more streamlined appearance, and to prolong the life of the apparatus by not exposing the components to adverse weather conditions.

Figure 5:
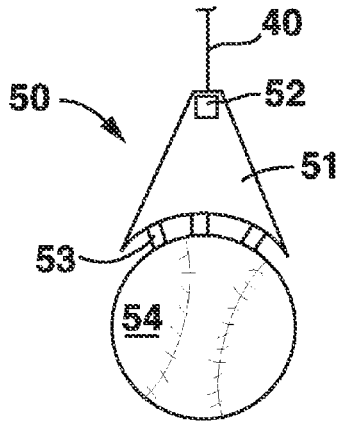
FIG. 5 is a front section detail of a ball attachment unit according to one embodiment of the present invention.

FIG. 5 illustrates one embodiment of a baseball attachment unit (BAU) 50 which can be used to attach a regulation sized baseball to the apparatus. To this end, the BAU 50 can include a main body 51 having a roughly triangular shape and including an opening 52 along the top and a plurality of fasteners 53 located along the bottom. As illustrated in FIG. 5, the tether 40 can be looped through the opening 52 in order to securely fasten the tether to the BAU, while the fasteners 53 can be used to securely attach to a baseball 54.

In a preferred embodiment, main body 51 can be constructed of hard plastic with a rubber coating to absorb any strikes received from a batter while attempting to hit the ball. Fasteners 53 can be constructed from virtually any known material capable of securing two objects together in either a removable or permanent nature such as, for example, double sided tape, hook and loop type fastener (i.e. Velcro®), magnetic elements (affixed to the ball and the BAU) or compression hardware such as a bolt or snap.

In one preferred embodiment, each of the lower shaft 11, upper shaft 12 and horizontal shaft 13 can be constructed from a sturdy yet lightweight material such as, for example, hardened plastic, aluminum or a composite blend, and include a length of approximately 2-3 feet each, thus allowing adequate room for a batter to utilize the apparatus and also allowing the apparatus to collapse into a small size.

Figure 6:
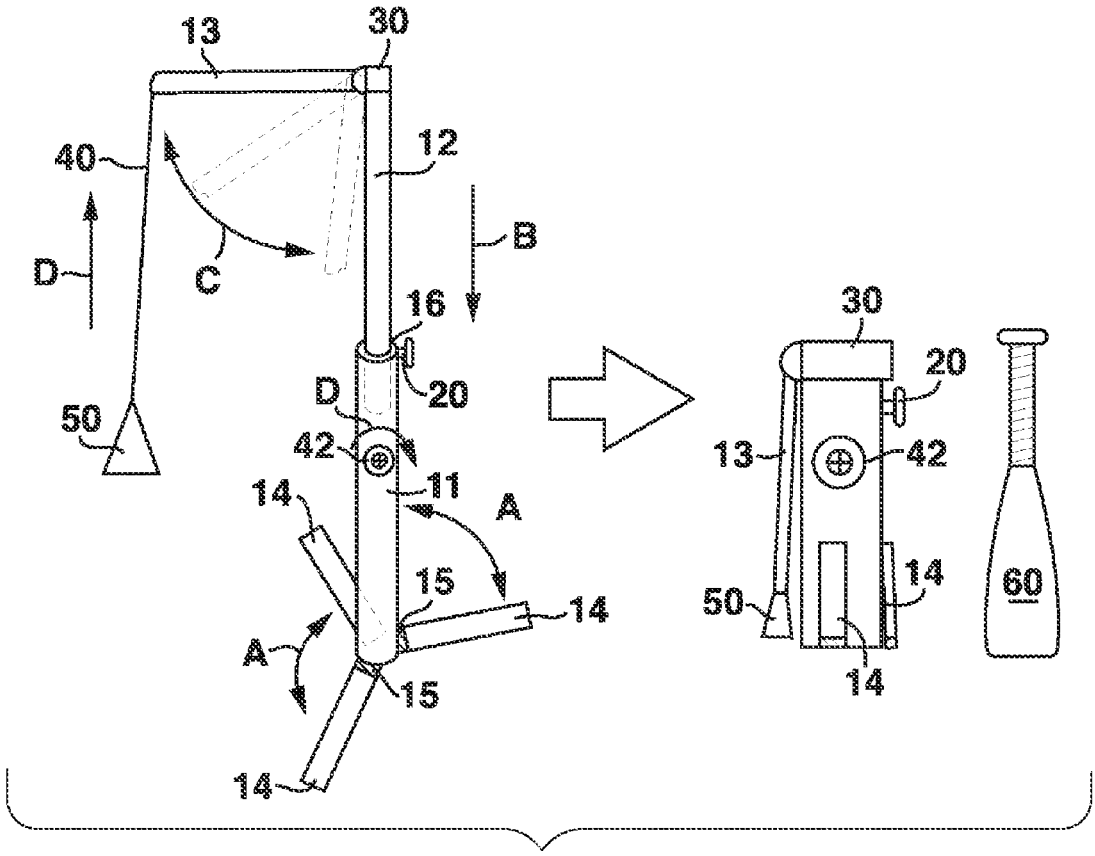
FIG. 6 is a side by side perspective view of the apparatus of the present invention in both an expanded and collapsed state.

As described above, the apparatus 10 can be fully collapsible so as to approximate the size of a baseball bat 60. This feature, as illustrated in FIG. 6 is beneficial for allowing the device to be portable enough to be transported alongside a players baseball equipment.

Figure 7:
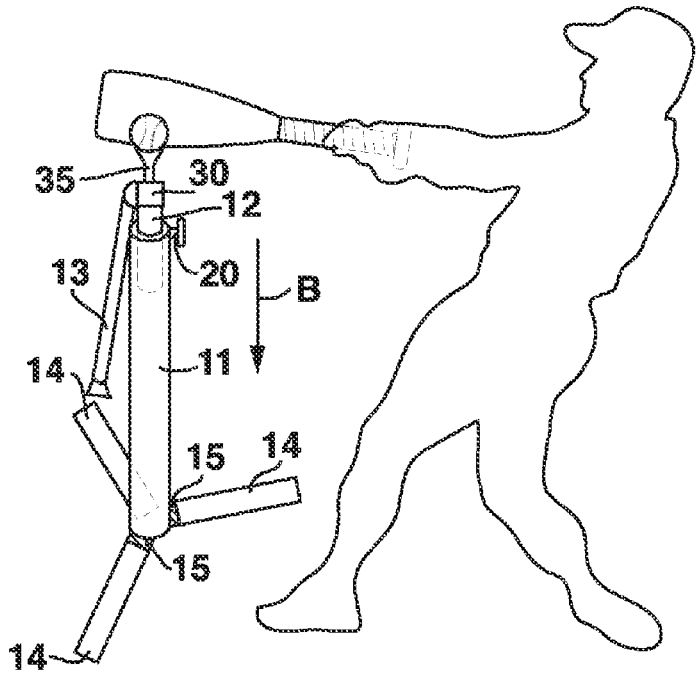
FIG. 7 is a side view of a player using the apparatus in a tee ball configuration.

FIGS. 7 and 8 illustrate the baseball hitting apparatus 10 in action. As shown in FIG. 7, the apparatus 10 can be configured for use as a tee ball stand. To this end, when legs 14 are extended, and the horizontal shaft is in a closed position, a baseball can be placed atop the ball tee 35. Moreover, upper shaft 12 can be raised and lowered to adjust the height of the ball tee for each individual player.

As illustrated in FIG. 8, the apparatus 10 can also be configured for use as a batting trainer or as an alternative to the conventional tee ball stand for use during play. In either case, when the apparatus 10 is in a fully expanded position, a baseball can be secured to the BAU and the height of the ball can be adjusted via the spindle 42. To this end, a player can strike the ball at several angles in order to master bat and ball control during a swing.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A baseball hitting apparatus comprising:

a first vertical member having a first end and a second end;

a second vertical member having a first end and a second end, wherein the first and second vertical members are connected in series;

an attachment collar interposed between the first vertical member and the second vertical member, said attachment collar being configured to adjust a height of the second vertical member;

an extension arm having a first end and a second end;

a folding attachment unit interposed between the first end of the extension arm and the second end of the second vertical member, said folding attachment unit being configured to fold the extension arm along a 90 degree vertical axis;

a ball tee having a vertical shaft and a concave upper portion configured to hold a baseball in an upright position, said ball tee being secured to a top portion of the folding attachment unit;

a plurality of folding support beams attached to the second end of the first vertical member, said support beams being configured to rotate towards and away from the first vertical member;

a ball attachment unit configured to grip a baseball; and a tether adjustment unit configured to adjust a length of a tether, wherein the tether is connected to the tether adjustment unit at a first end and the ball attachment unit at a second end.

2. The baseball hitting apparatus of claim 1, further comprising:

a hollow portion extending inward from the first end of the first vertical member, said hollow portion having a first diameter; and said second vertical member further includes a second diameter, wherein the first diameter is greater than the second diameter such that the first end of the second vertical member is configured to be telescopically inserted into the first end of the first vertical member.

3. The baseball hitting apparatus of claim 1, wherein said apparatus is configured to function as an adjustable height tee ball stand when said extension arm is in a downward folded position.

4. The baseball hitting apparatus of claim 1, wherein the second vertical member is configured to telescope vertically into the first vertical member and the second end of the extension arm is configured to fold adjacent to the second end of the first vertical member, thus forming a collapsed state having an overall dimension approximating a length and width of a baseball bat.

5. The baseball hitting apparatus of claim 1, wherein said ball attachment unit further includes at least one of an adhesive material, a magnetic element, a hook and loop fastener and a compression fitting.

6. The baseball hitting apparatus of claim 1, wherein said tether adjustment unit includes at least one of a spindle and cleat.

7. A baseball hitting means comprising:

a first vertical member having a first end and a second end;

a second vertical member having a first end and a second end, wherein the first and second vertical members are connected in series;

means for adjusting a height of the second vertical member;

an extension arm having a first end and a second end;

means for folding the extension arm along a vertical axis;

a ball tee having a vertical shaft and a concave upper portion configured to hold a baseball in an upright position, said ball tee being secured to a top portion of the means for folding attachment unit;

means for securing the hitting apparatus in an upright position;

means for removably gripping a baseball; and means for adjustably suspending a baseball from the horizontal member.

8. The baseball hitting means of claim 7, further comprising:

means for telescopically inserting a portion of said second vertical member into said first vertical member.

* * * * *